US006375175B1

(12) United States Patent
Baumann et al.

(10) Patent No.: US 6,375,175 B1
(45) Date of Patent: Apr. 23, 2002

(54) LIFTING MECHANISM

(75) Inventors: Michael Baumann, Wangen im Allgäu; Hans Peter Hager, Oberteuringen, both of (DE)

(73) Assignee: Winterhalter Gastronom GmbH, Meckenbeuren (DE)

( * ) Notice: Subject to any disclaimer, the term of this patent is extended or adjusted under 35 U.S.C. 154(b) by 0 days.

(21) Appl. No.: 09/611,959

(22) Filed: Jul. 6, 2000

(30) Foreign Application Priority Data

Jul. 9, 1999 (DE) ..... 199 31 877

(51) Int. Cl.[7] ..... F16F 1/12

(52) U.S. Cl. ..... 267/172; 267/173; 267/73; 49/445; 16/289; 16/291

(58) Field of Search ..... 267/73, 74, 170, 267/172, 173, 174; 49/445; 16/286, 289, 291

(56) References Cited

U.S. PATENT DOCUMENTS 1,846,583 A * 2/1932 Chase ..... 74/54
2,709,057 A * 5/1955 Gould ..... 248/543
2,845,263 A * 7/1958 Gund ..... 267/173
3,049,391 A * 8/1962 Meeker et al. ..... 312/272
3,745,083 A * 7/1973 Aungst et al. ..... 156/388
4,768,762 A * 9/1988 Lund ..... 267/172
5,791,546 A * 8/1998 McGuinness et al. ..... 227/120
6,243,988 B1 * 6/2001 Salice ..... 49/445

FOREIGN PATENT DOCUMENTS

| | | |
|---|---|---|
| DE | 10 63 932 | 12/1955 |
| FR | 23 52 527 A1 | 12/1977 |
| WO | 97 09 921 A1 | 3/1997 |

* cited by examiner

*Primary Examiner*—Christopher P. Schwartz
*Assistant Examiner*—Xuan Lan Nguyen
(74) *Attorney, Agent, or Firm*—Morgan, Lewis & Bockius LLP

(57) ABSTRACT

The invention relates to a lifting mechanism for spring-assisted actuation of a covering means of a dishwasher such as a door or shutter, having at least one lever which is mounted on a shaft and is connected to a tension spring. Arranged, in this case, between the lever and the spring is a mechanical control means which brings about a more or less constant lever arm between an articulation point of the spring and the shaft over an angle of rotation of the shaft of up to approximately 100°.

6 Claims, 5 Drawing Sheets

LIFTING MECHANISM

BACKGROUND OF THE INVENTION

1. Field of the Invention

The invention relates to a spring-assisted lifting mechanism, such as a door or shutter, for a dishwasher.

2. Discussion of the Related Art

The spring-assisted lifting mechanism is used, in dishwashers for the catering trade, to facilitate the operation of raising a covering means covering the dishwashing chamber. The spring-assisted lifting mechanism is intended to bring about a smooth-running movement of the covering means between a bottom position and a top position, the covering means being retained in the bottom position by its own weight and the [sic] retained in the top position by a spring force.

A known spring-assisted lifting mechanism for a covering means of a catering-trade dishwasher comprises two levers mounted on a shaft, the covering means being mounted in a rotatable and displaceable manner on the first lever, and a tension spring acting at the end of the second lever. The shaft, on which the levers are mounted, is fixed on the frame of the dishwasher via the second lever, with the aid of the spring, a moment is applied to the shaft. This moment brings about or assists a rotation of the shaft and/or of the first lever, with the result that an opening movement of the covering means is facilitated. In order to ensure vertical movement of the covering means, the covering means is guided, on the rear side, in a guide fitted on the frame of the dishwasher.

However, this lifting mechanism has considerable disadvantages. For example, a high force is necessary for the purpose of opening the covering means since, in this position of the lifting mechanism, the spring only acts on the shaft with a small effective lever length. As the covering means is opened to an increasing extent, the effective lever length increases, with the result that the lifting force acting on the covering means becomes greater and greater. During this opening operation, the operator initially senses a high resistance because the opening movement is only assisted to a minimal extent. Since the operator applies the force in accordance with the necessary opening force, the covering means is often displaced upward against a stop at high speed. This takes place because, on account of the improving lever arm between the spring and the shaft, the force which is to be applied by the operator decreases as the degree of opening increases. It is also the case that during closure of the covering means the properties of the mechanism result in an undesired, disadvantageous force profile. This is manifested in that first of all a large force and then an increasingly smaller force has to be applied in order to move the covering means from the top position into the bottom position. This characteristic of the lifting mechanism results in the operator first of all having to apply a large force in order to set the covering means in motion and then, on account of the resistance becoming lower, has difficulties in slowing down the covering means before the bottom position has been reached.

SUMMARY OF THE INVENTION

The object of the invention is to develop a spring-assisted lifting mechanism which, in all positions of the covering means, provides a load-relieving moment, which is adapted to the requirements of the operator, and thus allows exact, high-precision operation of the covering means with a small manual force.

The spring-assisted lifting mechanism for the covering means according to the invention comprises a control means which is arranged between the second lever and the tension spring a which brings about a more or less constant effective lever between an articulation point of the spring and the shaft over an angle of rotation of the shaft of up to approximately 100 degrees. This achieves the situation where the opening movement of the covering means is assisted by a virtually constant force, with the result that a force profile which is not, expected by the operator is not produced either during raising or during lowering of the covering means.

According to a preferred embodiment of the invention the control means is configured as an intermediate lever which is connected to the second lever and the tension springs In this case said intermediate lever at times is retained freely between the articulation points and at other times butts rotatably and displaceably against a support. This design allows a cost-effective, straightforward and space-saving embodiment of the lifting mechanism with more or less constant spring assistance.

An advantageous embodiment of the subject matter of the invention makes provision for the control means to be configured as a triangular compensating lever or toggle lever. Such a configuration of the control means allows the shaft to be used as a support and thus the design to be particularly straightforward.

According to a variant of the subject matter of the invention, it is provided that [sic] to design control means as a bolt which is mounted in two guide means and on which the spring is fastened. The guide means are formed by a slot in the second lever and by a fixed guide. This likewise makes it possible to provide a constant torque on the shaft since the effective lever remains constant.

A further variant of the subject matter of the invention provides that the second lever has a cam-like head, over the end side of which there runs a cable or band, the spring being fastened at the free end of said cable or band. If the end side of the cam is designed such that it is located on a circle around the shaft, then it is also possible in this case, with the aid of the spring, to apply a constant moment to the shaft.

BRIEF DESCRIPTION OF THE DRAWINGS

Further details of the invention are described, with reference to schematically illustrated exemplary embodiments, in the drawing, in which.

DETAILED DESCRIPTION OF THE PREFERRED EMBODIMENT

Figure 1:
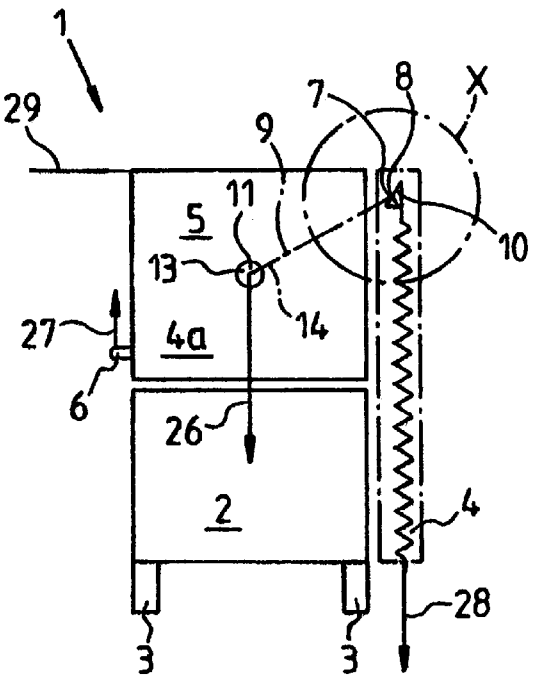
FIG. 1 shows a schematic side view of a dishwasher with the door closed.
Figure 3:
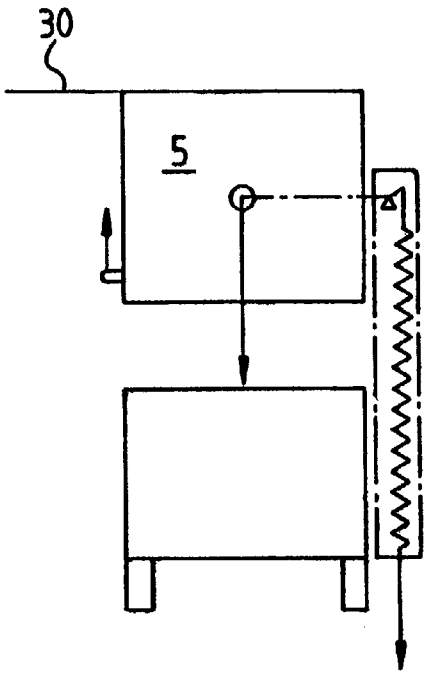
FIG. 3 shows a schematic illustration of the dishwasher with the door half open.

FIG. 1 illustrates a schematic side view of a dishwasher 1. The dishwasher 1 comprises a substructure 2 with feet 3 and a side part 4 which is fastened on the substructure 2. The dishwasher 1 also has a covering means 4*a*, which is configured as a door 5 which has a handle 6. Seated in the side part 4 is a bearing 7 which is configured as a shaft 8. Two levers 9, 10 are fastened on the bearing 7 or on the shaft 8. The lever 9 connects the shaft 8 to a rotatable bearing bolt 11 which is fitted on the door 5. The lever 9 is mounted displaceably in a guide 13 of the shaft 12. During opening of the door 5, the lever 9 slides back and forth in the guide 13 of the bearing bolt 11 by way a region 14 (cf. FIG. 3 and FIG. 5). The vertical movement of the door 5 is ensured by a vertical guide (not illustrated) which is arranged between the door and the side part.

Figure 2:
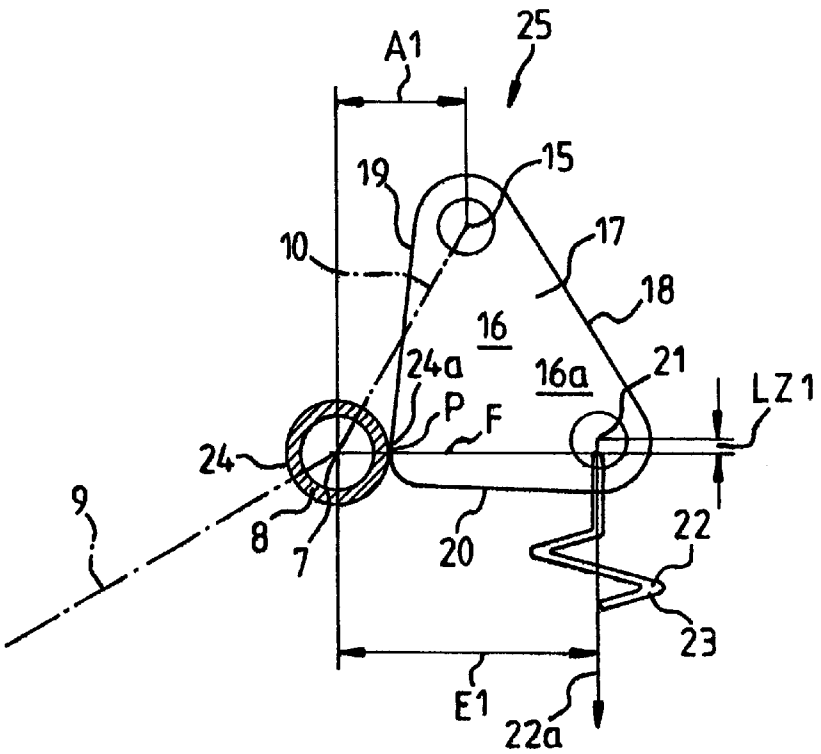
FIG. 2 shows a detailed illustration of the lifting mechanism marked by "X" in FIG. 1.

It can be seen from FIG. 2 that the lever 10 is connected rotatably to a control means 16 at an articulation point 15. The control means 16 is configured as a compensating lever 16a or triangular lever 17 which has a base 18, a side 19 and a side 20. Suspended at a further articulation point 21 of the triangular lever 17 is a spring 22 which has a longitudinal axis 22*a*. The spring 22 is designed as a tension spring 23 and is supported in the side part 4 of the dishwasher 1 (see FIG. 1). The shift 8 has a surface 24 against which the triangular lever 17 butts by way of the side 19. The spring 22, the triangular lever 17, the lever 10, the bearing 7 and the lever 9 form a lifting mechanism 25. The lifting mechanism 25 assists an operator during opening and closing of the door 5 and also helps retain the door 5 in the open position. For opening purposes, the operator has to overcome the weight 26 (cf. FIG. 1) of the door 5 by the manual force 27 applied by him/her (cf. FIG. 1), the operator being assisted here by the spring force 28 (cf. FIG. 1) of the spring 22.

The functioning of the lifting mechanism 25 is described hereinbelow with reference to FIGS. 1 to 6. FIGS. 1, 3, 5 and 2, 4, 6 respectively show the door 5 of the dishwasher 1 and the lifting mechanism 1 [sic] in a closed position 29, in a half-open position 30 and in an open position 31.

Figure 5:
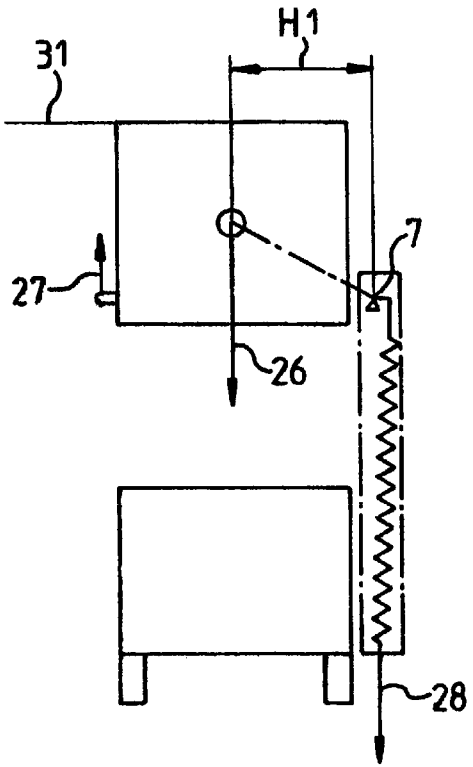
FIG. 5 shows a schematic illustration of the dishwasher with the door open.

As can be seen from FIG. 5, the weight 26 of the door 5 acts on the bearing 7 with a lever H1. The force opposing the weight 26 is applied by the manual force 27 and the spring force 28.

It can be seen in FIG. 2 that the spring 22 acts on the bearing 7 via the triangular lever 17 and the lever 10. The spring 22 thus acts on the bearing 7 with an effective lever E1 since the triangular lever is supported at a point P on the surface 24 of the shaft 8 by way of its side 19. By virtue of the lever 10, the triangular lever 17 is blocked such that only joint rotation of the triangular lever 17 with the shaft 8 can take place.

Figure 4:
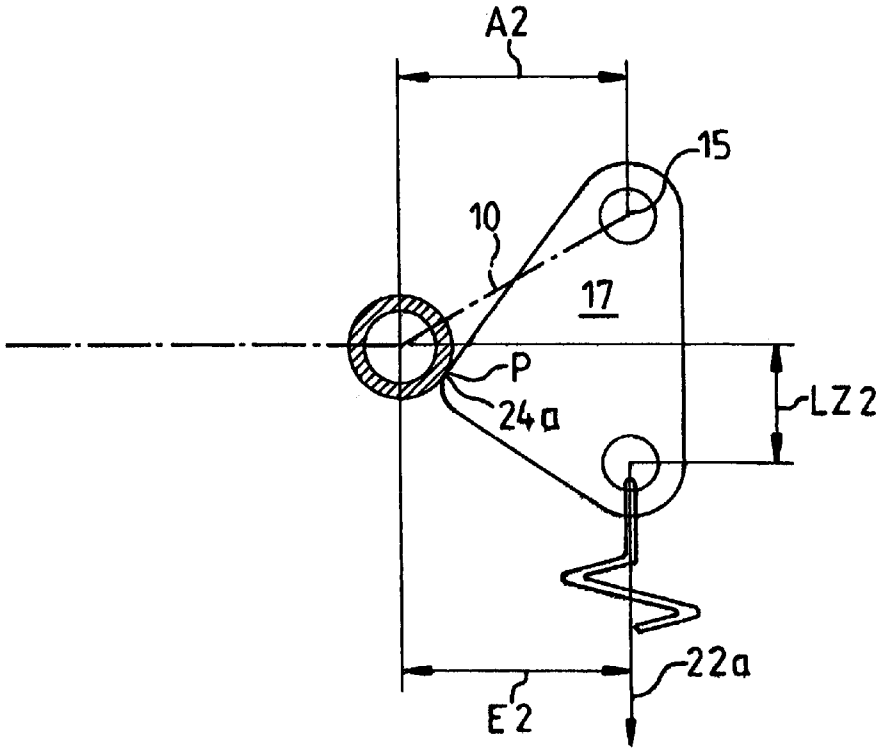
FIG. 4 shows a detailed illustration of the lifting mechanism of the dishwasher when the door is half open.

Until approximately the half-open position 30 of the door 5 has been reached, the triangular lever 17 butts against the surface 24 of the shaft 8 by way of the point P, said surface forming a support 24*a* for the triangular lever 17. On the way into the half-open position 30, the triangular lever 17 rotates jointly with the shaft 8. This means that the moment by which the spring 22 acts on the bearing 7 remains approximately equal between the closed position 29 and the half-open position 30 since the articulation point 21 of the spring 22 only moves through a small angle on a circular path around the bearing 7. This means that the effective lever E2 illustrated in FIG. 4 is only slightly smaller than the effective lever E1 illustrated in FIG. 2. By virtue of the rotation of the triangular lever 17 about the bearing 7, the articulation point 15 of the lever 10 has also been displaced, with the result that the lever A2 corresponds approximately to the lever E2. In the closed position 29 of the door 5, the lever A1 was still considerably smaller than the lever E1 of the triangular lever 17 (cf. FIG. 2).

During further displacement of the door 5 into the open position 31, the lever 10 with its effective lever A2 then becomes determinative since the point P moves away from the surface 24 of the shaft 8. This is because the spring 22 then no longer subjects the triangular lever 17 to any moment about the articulation point 15 and it is thus also the case that there is no longer any force which presses the triangular lever 17 onto the shaft 8 at point P.

A variant which is not illustrated provides that the triangular lever 17 butts against the surface 24 of the shaft 8 by way of an articulation indent configured as a recess on the triangular lever 17. This means that the triangular lever 17 has surface contact with the shaft 8.

Figure 6:
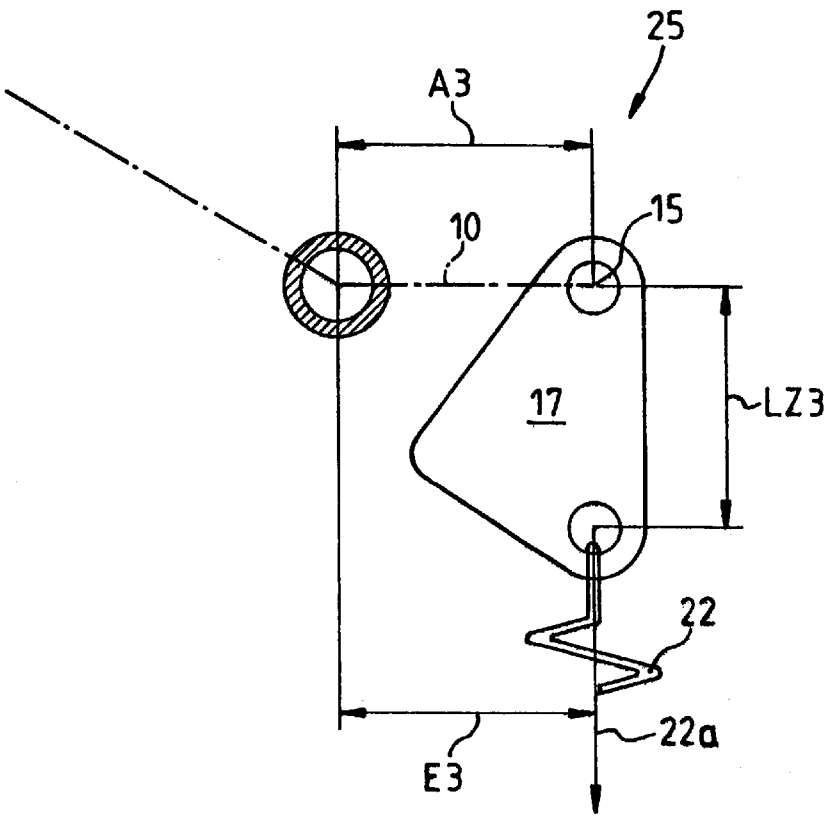
FIG. 6 shows a detailed illustration of the lifting mechanism when the door is open.

FIG. 6 illustrates the position of the lever mechanism 25 which the latter assumes in the open position 31 of the door 5. It can be seen that the effective lever A3 is determined by the lever 10. This means that the effective lever A3 has become slightly greater than the effective lever A2 (cf. FIG. 4) since the lever 10 has moved on a circular path around the bearing 7 between the half-open position 30 and the open position 31 of the door 5. Comparing FIGS. 2 and 6, it can be seen that, in the closed position 29 of the door 5, the spring 22 is stressed to a more pronounced extent by a distance LZ1+LZ3 in relation to the open position 31, this resulting in the door 5 being subjected to a somewhat more pronounced moment in the closed position 29.

Overall, between the closed position 29 and the half-open position 30, the lever mechanism 25 brings about a sinusoidal decrease in the effective lever-arm length by means of which the spring 22 acts on the shaft 8. Between the half-open position 30 and the open position 31 of the door 5, the lifting mechanism 25 brings about a sinusoidal increase in the effective lever-arm length by means of which the spring 22 acts on the shaft 8. By virtue of the spring stressing decreasing during the opening operation, the spring 22 acts on the lever mechanism 25 with a decreasable force. Thus, during opening of the door 5, the shaft 8 is subjected to a moment which, as the door 5 is opened to an increasing extent, decreases slightly to approximately the central position of said door. Between the central position and the open position of the door 5, the moment acting on the shaft 8 increases again slightly.

Figure 7:
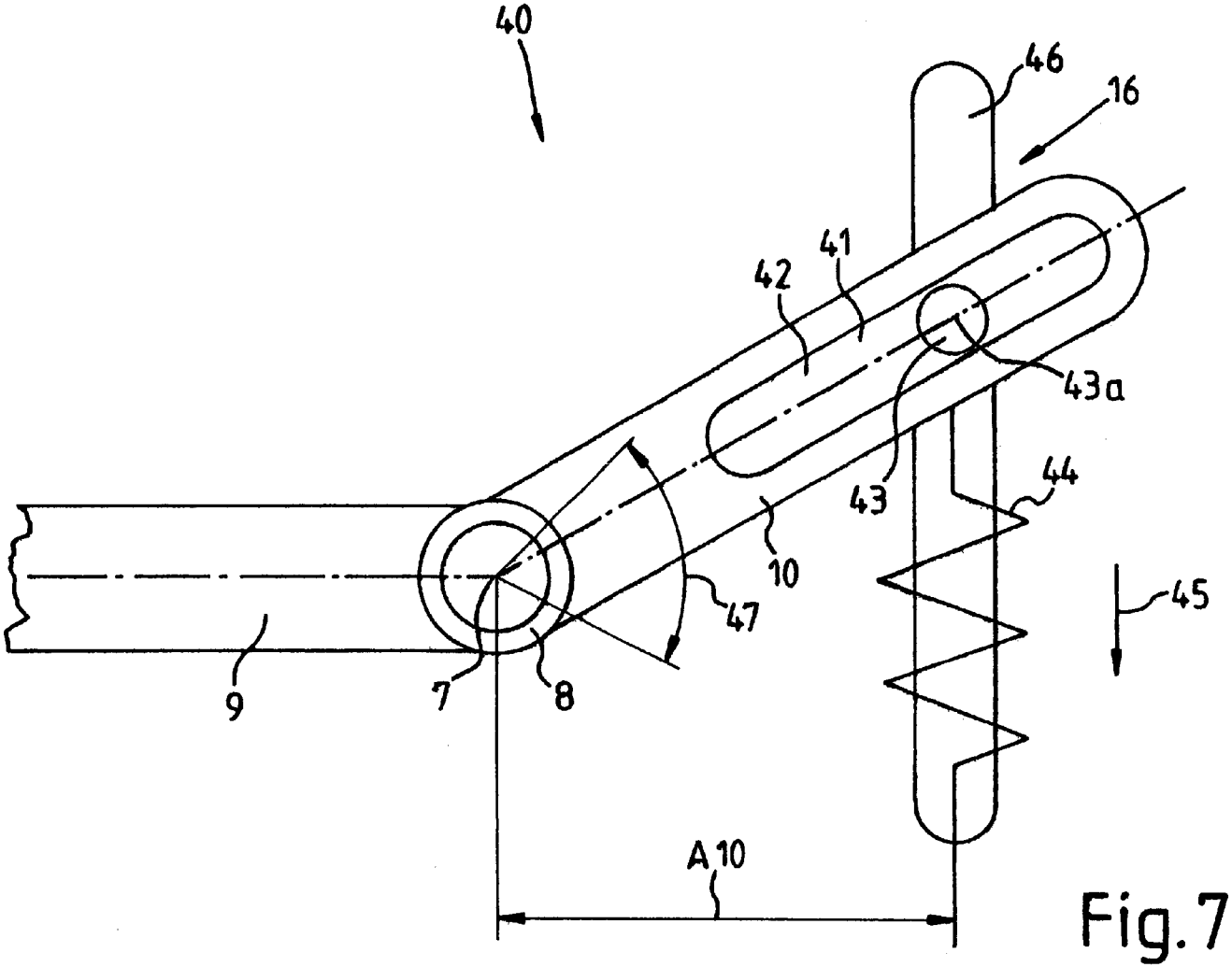
FIG. 7 shows a schematic illustration of a variant of the lifting mechanism.

FIG. 7 shows a schematic illustration of a variant of the lifting mechanism 25. Analogously to the lifting mechanism 25 illustrated in FIGS. 1 to 6, the lifting mechanism 40 illustrated in FIG. 7 likewise has a first lever 9, a second lever 10, a bearing 7 and a shaft 8. The dishwasher 1 has not been illustrated here since the lifting mechanism 40 illustrated in FIG. 7 is likewise provided for the dishwasher 1 illustrated in FIGS. 1, 3 and 6.

The second lever 10 has a slot 42 which is configured as a guide 41 and in which a bolt 43 is mounted in a displaceable manner. Fastened on the bolt 43, at an articulation point 43a, is a tension spring 44 which draws the bolt 43 in the direction of the arrow 45 and is supported in the side part 4 (not illustrated here). Furthermore, the bolt 43 is mounted in a guide 46, formed in the side part 4, such that it can be displaced in the vertical direction. Mounting the bolt 43 in the guides 41 and 46 ensures that an effective lever A10, by means of which the bolt 43 and the spring 44 act on the shaft 8 via the second lever 10, remains more or less constant in an angle range 47. The bolt 43 and the guides 41, 46 here form a control means 16.

An exemplary embodiment of the subject matter of the invention which is not illustrated provides for the guide 46 to be of curved design. This makes it possible for the profile of the moment acting on the shaft 8 to be freely determined and adapted to the force profile favorable for an operator.

Figure 8:
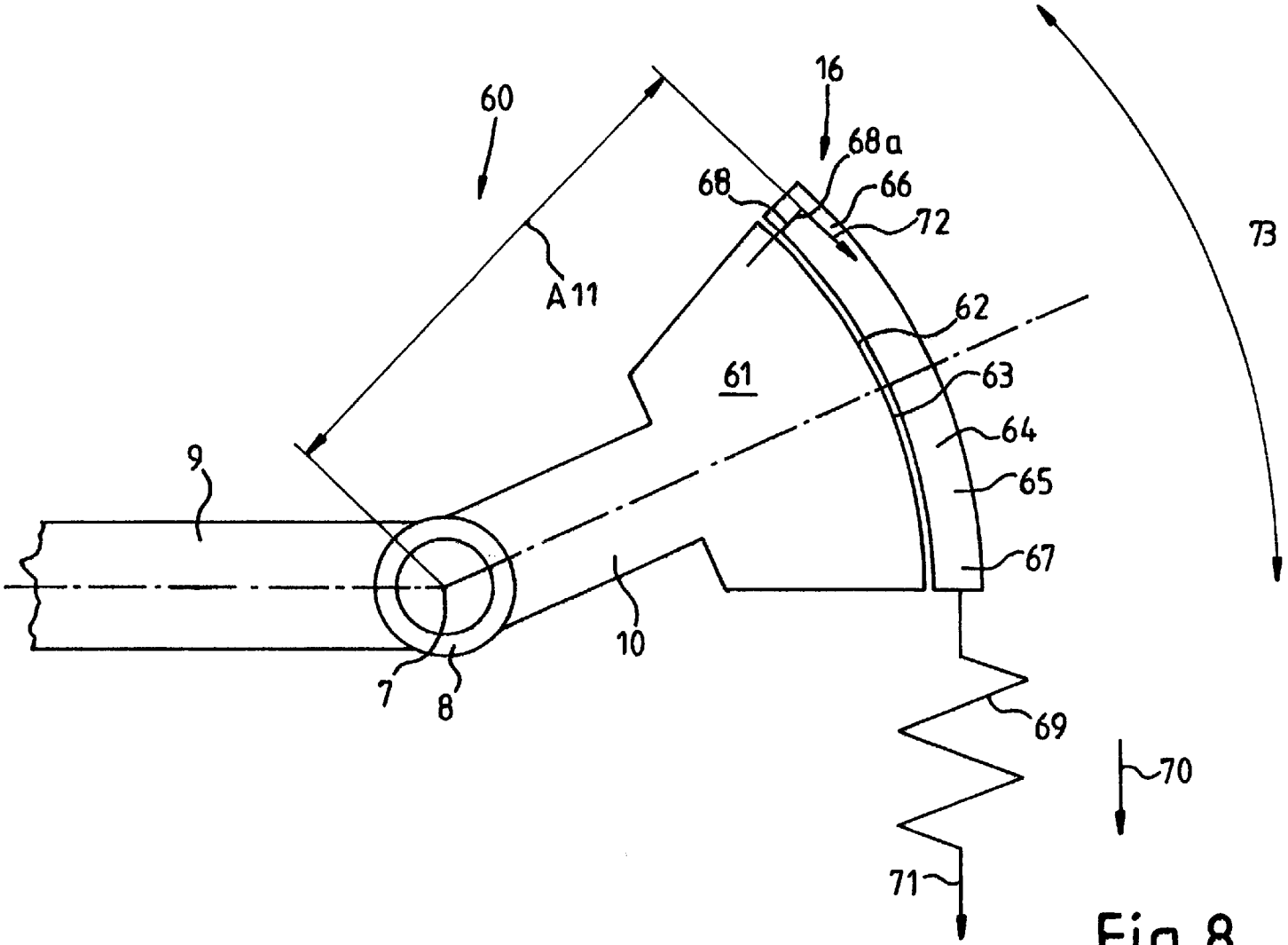
FIG. 8 shows a schematic illustration of a further variant of the lifting mechanism.

FIG. 8 shows, by way of the lifting mechanism 60, a further variant of the lifting mechanism 25. This lifting mechanism, in turn, has a first lever 9, a second lever 10, a bearing 7 and a shaft 8. The second lever 10 has a cam-like head 61 which exhibits an end side 62 with a rounded surface 63. On the end side 62 it is possible to see a connecting means 64 which is configured as a band 65 with an end 66 and an end 67. The band 65 is fastened at an articulation point 68*a* with the aid of a fastening means 68. A spring 69 is articulated at the end 67 of the band 65. The spring 69 forces the band 65 in the arrow direction 70 and is itself supported in the side part 4 (not illustrated here).

In the case of the lifting mechanism 60, a force 71, which the spring 69 exerts on the band 65 in the direction of the arrow 70, is deflected on the rounded surface 63 of the cam-like head 61. By virtue of the deflection, the force 71 acts on the fastening means 68 in the arrow direction 72 and thus acts on the shaft 8 with an effective lever All. The effective lever 11 [sic], by means of which the force 71 acts on the shaft 8, remains constant during rotation of the second lever 10 over an angle range 73 since the force 71 always acts on the fastening means 68 tangentially to the rounded surface 63. The cam-like head 61, the connecting means 64 and the band 65 here form a control means 16.

A further exemplary embodiment which is not illustrated provides for the end side 62 of the cam-like head 61 to be provided with elevations and depressions, with the result that the configuration thereof can influence the lever arm by means of which the spring 69 acts on the shaft 8. According to the invention, the connecting means is pressed into the depressions of the end side 62 by a mating means.

The invention is not restricted to exemplary embodiments which have been illustrated or described. They also cover the developments of the invention within the context of the claims.

What is claimed is:

1. A lifting mechanism for spring-assisted actuation of a covering means of a dishwasher comprising:

at least one lever mounted on a shaft and connected to a tension spring;

a mechanical control means arranged between the lever and the spring to produce a constant lever arm between an articulation point of the spring and the shaft over an angle of rotation of the shaft of up to approximately 100°;

wherein the mechanical control means is configured as an intermediate lever connected to the at least one lever at a first articulation point and to the tension spring at a second articulation point, the intermediate lever at times being retained freely between the first and second articulation points and at other times butting rotatably against a support.

2. The lifting mechanism according to claim 1, further comprising a further lever mounted on the shaft having a region on which a covering means is mounted in a rotatable and displaceable manner.

3. The lifting mechanism according to claim 1, wherein the shaft serves as a support for the mechanical control means.

4. A lifting mechanism for spring-assisted actuation of a covering means of a dishwasher comprising:

at least one lever mounted on a shaft and connected to a tension spring;

a mechanical control means arranged between the lever and the spring to produce a constant lever arm between an articulation point of the spring and the shaft over an angle of rotation of the shaft of up to approximately 100°;

wherein the mechanical control means is configured as a triangular compensating lever.

5. The lifting mechanism according to claim 4, wherein the lever and the spring are each articulated in acute angles of the triangular compensating lever.

6. A lifting mechanism for spring-assisted actuation of a covering means of a dishwasher comprising:

at least one lever mounted on a shaft and connected to a tension spring;

a mechanical control means arranged between the lever and the spring to produce a constant lever arm between an articulation point of the spring and the shaft over an angle of rotation of the shaft of up to approximately 100°;

wherein the mechanical control means is configured as an intermediate lever connected to the at least one lever at a first articulation point and to the tension spring at a second articulation point, the intermediate lever at times being retained freely between the first and second articulation points and at other times butting rotatably against a support;

wherein the mechanical control means is supported in the support as long as a longitudinal axis of the spring is aligned with the first articulation point.

* * * * *